US006457855B1

(12) United States Patent
Beirau et al.

(10) Patent No.: US 6,457,855 B1
(45) Date of Patent: Oct. 1, 2002

(54) MICRO MIXER

(75) Inventors: Andreas Beirau, Darmstadt; Michael Schmelz, Kriftel; Frank Schwarz, Frankfurt; Jöran Stoldt, Weiterstadt, all of (DE)

(73) Assignee: Merck Patent Gesellschaft mit, Darmstadt (DE)

( * ) Notice: Subject to any disclaimer, the term of this patent is extended or adjusted under 35 U.S.C. 154(b) by 0 days.

(21) Appl. No.: 09/530,041

(22) PCT Filed: Oct. 12, 1998

(86) PCT No.: PCT/EP98/06461

§ 371 (c)(1),
(2), (4) Date: May 26, 2000

(87) PCT Pub. No.: WO99/20381

PCT Pub. Date: Apr. 29, 1999

(30) Foreign Application Priority Data

Oct. 22, 1997 (DE) ..... 197 46 581

(51) Int. Cl.[7] ..... B01F 15/00
(52) U.S. Cl. ..... 366/336; 366/349
(58) Field of Search ..... 366/173.1, 171.1, 366/336, 340, 349

(56) References Cited

U.S. PATENT DOCUMENTS

| | | | | |
|---|---|---|---|---|
| 3,459,407 | A | * | 8/1969 | Hazlehurst et al. |
| 4,219,143 | A | * | 8/1980 | Gailland |
| 4,394,263 | A | | 7/1983 | Dosch et al. |
| 4,699,083 | A | * | 10/1987 | Huet et al. |
| 4,858,471 | A | * | 8/1989 | Wareham |
| 6,033,628 | A | * | 3/2000 | Kaltenbach et al. |
| 6,036,927 | A | * | 3/2000 | Chatterjee |
| 6,367,964 | B1 | * | 4/2002 | Schmelz et al. ..... 366/336 |

FOREIGN PATENT DOCUMENTS

| | | |
|---|---|---|
| DE | 196 11 270 A | 9/1997 |
| EP | 0 107 631 A | 5/1984 |
| WO | WO 98/25065 A | 6/1998 |

* cited by examiner

*Primary Examiner*—Tony G. Soohoo
(74) *Attorney, Agent, or Firm*—Millen, White, Zelano & Branigan, P.C.

(57) ABSTRACT

A micro mixer for liquid, viscous or gaseous phases with two adjacent housing parts (1,2) disposed on a parting plane (3). Capillary tubes (7) forming line connections are inserted into cross holes (6) in the top part of the housing (1) by welding, for instance, and run into the parting plane (3). The other free ends of the capillary tubes (7) are bent apart and respectively bear a screw connection.

6 Claims, 1 Drawing Sheet

MICRO MIXER

FIELD OF THE INVENTION

Background of the Invention

The invention relates to a micromixer having at least two housing parts which bear against one another in a parting plane and of which at least a housing top part has line connections for connection lines which open out in the parting plane.

Micromixers for liquid, viscous or gaseous phases are becoming increasingly important if, for chemical reactions, precise temperature control and intimate mixing of the components are of decisive importance and, at the same time, reliable process control is required and/or the safety of the process sequence is an important factor. These requirements can be ensured more easily by restricting the mass flow rates to low levels.

Usually, the grooves which form the mixing section and any further process devices as well as the required passages are formed, for example by etching, in one of the two surfaces which bear against one another in the parting plane. In this context, connecting the feed lines and discharge lines for the components to be mixed and the mixture to the micromixer presents difficulties. Within the housing top part, the connection lines which open out in the parting plane are often arranged very close together. They have to be positioned with accuracy, so that precise connection to the passages in the parting plane is ensured. In that surface of the housing top part which faces towards the parting plane, the connection lines must be flush and smooth in order to ensure that the connection and the mixer remain sealed. Moreover, in particular in this area also, dead spaces are to be avoided. At the same time, however, it must be possible to provide screw connections for the individual connection lines on the outside of the micromixer. These screw connections take up a relatively large amount of space, in particular when it is taken into account that the screw connections require the use of a tool, and the operating staff often has to work wearing protective gloves. If a plurality of connections have to be provided in an extremely restricted space, it is often impossible to use screw connections. This makes the operation of changing connections very laborious and time-consuming.

SUMMARY OF THE INVENTION

Therefore, the object of the invention is to design a micromixer of the type described in the introduction in such a way that the abovementioned requirements are fulfilled and, in particular, simple handling becomes possible.

According to the invention, this object is achieved by the fact that the line connections have capillary tubes, in each case one end of which is fitted tightly into a transverse hole, leading to the parting plane, in the housing top part.

This makes it possible to introduce a plurality of line connections into the housing top part within tight spatial conditions without it being necessary to provide screw connections or similar connecting elements on the housing top part itself. In particular, the capillary tubes, in their sections which lie outside the housing top part, may be guided appropriately for the line connections and for ease of handling.

Preferably, each capillary tube is provided with a screw connection at its other, free end. Since the capillary tubes can be bent in any desired way, there is sufficient space for handling the tool available for each screw connection.

Advantageously, for this purpose the capillary tubes are bent apart at their free ends.

The capillary tubes may be secured in the transverse holes by means of welding, soldering or adhesive bonding depending on the particular materials used.

According to a preferred embodiment of the invention, the capillary tubes extend all the way to the parting plane. This is advantageous from a manufacturing technology viewpoint, since the transverse holes, which receive the capillary tubes, in the housing top part can be designed as continuous cylindrical holes, and since any dead spaces are avoided, as the line cross section of the capillary tubes runs without obstacle and without any widening all the way into the parting plane.

Expediently, that surface of the housing top part which faces towards the parting plane, in the outlet area of the capillary tubes, is ground and polished after the capillary tubes have been fitted. In this way, the connection is sealed in a simple manufacturing sequence and with a high level of accuracy and the formation of dead spaces is avoided even in the area of the parting surface.

BRIEF DESCRIPTION OF THE DRAWINGS

An exemplary embodiment of the invention is explained in more detail below and is illustrated in the drawing, in which.

DETAILED DESCRIPTION

Figure 1:
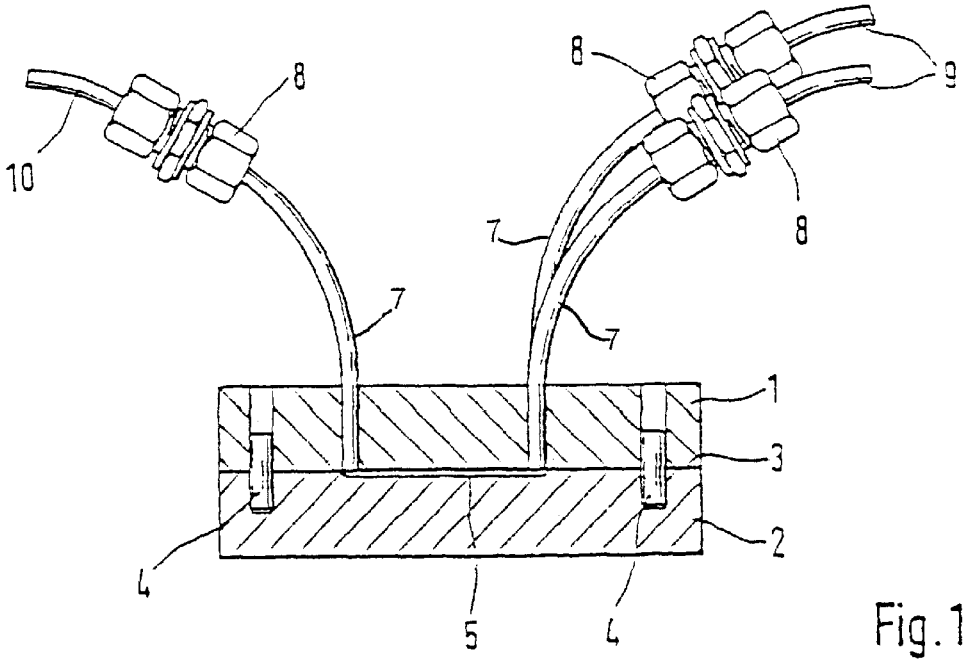
FIG. 1 shows a section through a micromixer.

The micromixer which is shown in the drawing and is used to mix very small mass flows of liquid, viscous or gaseous phases has a substantially plate-like first housing part or top part 1 and a second housing part or bottom part 2 which is likewise substantially in the form of a plate, the said parts bearing tightly against one another at an interface defined at a parting plane 3 by means of surfaces which face towards one another. The housing top part 1 and the housing bottom part 2 are pressed together by a clamping device (not shown), for example by screws which are distributed over the periphery or clamping ring which engages around the housing parts. As is evident from the cross hatching of the drawings, in a preferred embodiment the two housing parts 1 and 2 are made of metal. Two centering pins 4, for example, are provided in order to center the housing top part 1 with respect to the housing bottom part 2.

In the exemplary embodiment illustrated, that surface 1*a* of the housing top part 1 which faces towards the parting plane 3 is plane-ground and polished. Passage grooves 5, which form a mixing section, for example, are etched into that surface 2*a* of the housing bottom part 2 which faces towards the parting plane 3 and is likewise plane-ground and polished.

In the housing top part 1 there are transverse holes 6 which open out in the parting plane 3 and run perpendicular to the latter. One end of a capillary tube 7 is fitted into each transverse hole 6, for example welded in using a laser-welding process. Depending on the type of materials used for the capillary tubes 7 and for the housing top part 1, it is also possible to use other joining processes, for example soldering or adhesive bonding. In the exemplary embodiment illustrated, the capillary tubes 7 are made of metal.

At its other, free end, each capillary tube 7 is provided with a conventional screw connection 8 which enables the lines 9 which are used to supply the components to be mixed and the line 10 which is used to discharge the mixture to be connected releasably.

As can be seen from FIG. 1, the free ends of the capillary tubes 7 are bent apart outwards in such a way that there is sufficient space to manipulate the screw connections 8, so that it is also easily possible to use tools and to work wearing protective gloves. This makes it possible to use various commercially available screw connections 8 which allow simple coupling and uncoupling of the micromixer.

Figure 2:
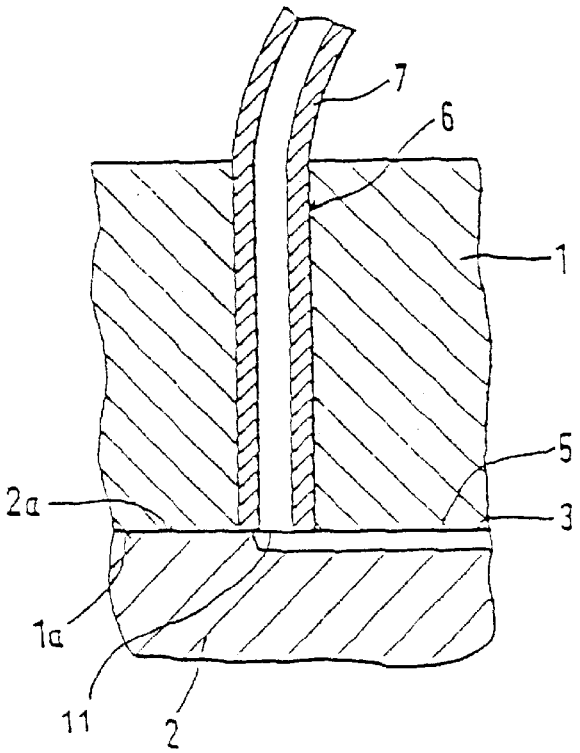
FIG. 2 shows an enlarged partial section in the area of a connected capillary tube.

As can be seen in particular from FIG. 2, the capillary tube 7 extends all the way to the parting plane 3. Like the entire surface 1*a*, the outlet end 11 defining the outlet opening of the capillary tube is also ground and polished. The capillary tube 7 opens out at the end of the passage groove 5 to which it is to be connected. Accurate positioning is ensured by the fact that the housing top part 1 is centered with respect to the housing bottom part 2 by means of the centering pins 4 even after the micromixer has opened and closed again.

What is claimed is:

1. A micromixer for chemical reactions of liquid, viscous or gaseous phases comprising: at least two metal housing parts (1 and 2) which bear directly against one another over an interface defined by a parting plane (3) and of which at least a first housing part (1) has line connections which open into the parting plane and a second housing part (2) relieved to define a passage groove (5) opening through the parting plane (3) in communication with the line connections, wherein the line connections are metal supply and discharge capillary tubes (7); wherein in each case one end of each capillary tube (7) is fitted tightly into a transverse hole (6) through the first housing part (1) leading to the parting plane (3) and is secured therein by welding or soldering, and wherein each capillary tube is provided with a screw connection (8) at a free end thereof, whereby fluids introduced into the passage groove from the supply capillary tubes are mixed in the passage groove and removed from the passage groove by the discharge capillary tube.

2. A micromixer according to claim 1 wherein the capillary tubes (7) are bent to be spaced apart at their free ends.

3. A micromixer according to claim 1, wherein the capillary tubes (7) extend all the way to the parting plane (3) and have outlet ends (11) at the parting plane (3).

4. A micromixer according to claim 3, wherein a surface (1*a*) of the first housing part (1) which faces towards the parting plane (3), adjacent to the outlet ends (11) of the capillary tubes (7), is ground and polished after the capillary tubes (7) have been fitted to provide ground and polished surfaces so that the surface (1*a*) and outlet ends (11) of the capillary tubes (7) are flush with one another.

5. The micromixer of claim 1 wherein there are pins projecting from one housing part which are received in bores in the other housing part to align correctly one housing part with respect to he other, so that the capillary tubes (7) communicate with the passage groove (5).

6. The micromixer of claim 5, wherein the first housing part (1) is a top housing part and the second housing part (2) is a bottom housing part.

* * * * *